US007100674B2

(12) United States Patent
Kim et al.

(10) Patent No.: US 7,100,674 B2
(45) Date of Patent: Sep. 5, 2006

(54) METHOD OF STARTUP PROCEDURE OF STRIP IN THE TWIN ROLL STRIP CASTING PROCESS

(75) Inventors: Yoon-Ha Kim, Kyungsangbuk-do (KR); Wan-Soo Kim, Kyungsangbuk-do (KR); Dae-Sung Lee, Kyungsangbuk-do (KR)

(73) Assignee: Posco Co., Ltd., Pohang-shi (KR)

( * ) Notice: Subject to any disclaimer, the term of this patent is extended or adjusted under 35 U.S.C. 154(b) by 0 days.

(21) Appl. No.: 10/535,216

(22) PCT Filed: Nov. 12, 2003

(86) PCT No.: PCT/KR03/02426

§ 371 (c)(1),
(2), (4) Date: May 17, 2005

(87) PCT Pub. No.: WO2004/056506

PCT Pub. Date: Jul. 8, 2004

(65) Prior Publication Data

US 2006/0037732 A1 Feb. 23, 2006

(30) Foreign Application Priority Data

Dec. 23, 2002 (KR) ..... 10-2002-0082639

(51) Int. Cl.
*B22D 11/06* (2006.01)
*B22D 11/08* (2006.01)

(52) U.S. Cl. ..... 164/480; 164/483

(58) Field of Classification Search ..... 164/483, 164/480

See application file for complete search history.

(56) References Cited

FOREIGN PATENT DOCUMENTS

| | | |
|---|---|---|
| JP | 59215257 | 12/1984 |
| JP | 06114504 | 4/1994 |
| JP | 6-315742 | * 11/1994 |
| KR | 2002-017028 | * 3/2002 |

OTHER PUBLICATIONS

English-language Abstract of Japanese Publication No. 06-114504 Patent Abstracts of Japan, published Apr. 26, 1994.
English-language Abstract of Japanese Publication No. 59-215257, Patent Abstracts of Japan, published Dec. 5, 1984.

* cited by examiner

*Primary Examiner*—Kuang Y. Lin
(74) *Attorney, Agent, or Firm*—Cooper & Dunham LLP

(57) ABSTRACT

Disclosed herein is a method for drawing a strip initially cast by means of a twin roll strip casting apparatus. The method comprises a roll gap maintenance step where roll gap is maintained, a casting initiation step where a stopper is disengaged from a tundish hole so that molten metal is poured into a space between the rolls, and the rolls are rotated at speed $v_0$ of each of the rolls if the position of the stopper is higher than the actually poured position of the molten metal, a casting speed acceleration step where a roll repulsive force is detected when the molten metal is solidified to the leader strip and passes between the rolls, and the casting speed is accelerated if the roll repulsive force reaches a load threshold, and a normal control step where the casting speed is detected, and if the casting speed reaches a target value.

4 Claims, 3 Drawing Sheets

Fig. 3

METHOD OF STARTUP PROCEDURE OF STRIP IN THE TWIN ROLL STRIP CASTING PROCESS

TECHNICAL FIELD

The present invention relates to a method for drawing a strip initially cast by means of a twin roll strip casting apparatus, and more particularly to a method for drawing a strip initially cast by means of a twin roll strip casting apparatus, which is capable of safely drawing the strip cast by means of the twin roll strip casting apparatus, by which the strip is directly cast from molten metal, to a coiler with a leader strip when a strip casting process is initiated, whereby not only a casting process but also a coiling process is safely carried out.

BACKGROUND ART

As well known to those skilled in the art, molten metal maintained at a prescribed temperature passes between rotating rolls of a twin roll strip casting apparatus so that a strip having a thickness desired by users is manufactured. In the case of casting a strip having such desired thickness, it is very important to accurately control a gap defined between the rolls of the twin roll strip casting apparatus. Moreover, it is very important to safely draw the cast strip to a coiler.

FIG. 1 is a schematic view illustrating a strip casting process in a general twin roll strip casting apparatus. As shown in FIG. 1, the strip casting process is carried out from a molten metal receiving space 7 defined between two rolls of the twin roll strip casting apparatus, which are rotated in opposite directions, such as a stationary roll 1 and a movable roll 2. When a stopper 5 is moved upward so that the stopper 5 is disengaged from a tundish hole 6 of a tundish 3, the molten metal is supplied from the tundish 3 to the molten metal receiving space 7 defined between the stationary roll 1 and the movable roll 2 through the tundish hole 6 and a nozzle 4. The molten metal supplied to the molten metal receiving space 7 is solidified between the rolls 1 and 2 within 0.2 second. The solidified metal is rolled to form a strip 10, which is wound onto a coiler 12 via a discharge line 11. The height of the molten metal is detected by means of a height-detecting sensor 8 for detecting the height of the molten metal. It is basically considered that the height of the molten metal reaches a target value immediately after the strip casting process is initiated.

According to the conventional method for drawing a strip initially cast by means of the twin roll strip casting apparatus, the strip having passed between the rolls of the twin roll strip casting apparatus is drawn via the discharge line 11. When the strip casting process is initiated, the stopper 5 is moved upward so that the stopper 5 is disengaged from the tundish hole 6 of the tundish 3. Consequently, the molten metal is supplied from the tundish 3 to the molten metal receiving space 7. At this time, a first portion of the molten metal passes between the rolls 1 and 2 while being solidified. Subsequently, the solidified strip 10, which follows the first solidified portion of the molten metal, is successively rolled between the rolls 1 and 2, drawn along the discharge line 11, and wound onto the coiler 12.

In the conventional method for drawing the initially cast strip, however, timing of the drawing is not accurately established. In the case that a solidification transition procedure of the molten metal is unstable as described above, all subsequent normal operations may not be carried out.

Especially when excessive solidification of the strip occurs in the course of initial solidification, the rolls may be damaged. When the strip is not appropriately solidified, on the other hand, the strip may be broken, or the molten metal may flow out, which leads to suspension of the operations. Furthermore, a leader strip may be molten due to the molten metal having a high temperature in the case that the above-mentioned procedure is not smoothly carried out.

The process of drawing the initially cast strip, which is carried out when the strip casting process is initiated, is very important, and therefore a method for efficiently carrying out the above-mentioned process is increasingly required.

DISCLOSURE OF THE INVENTION

Therefore, the present invention has been made in view of the above problems, and it is an object of the present invention to provide a method for drawing a strip initially cast by means of a twin roll strip casting apparatus, which is capable of safely drawing an initial strip solidified to a leader strip disposed above a roll nip when a strip casting process is initiated to a coiler under consideration of a starting speed of each of rolls, a roll repulsive force while the leader strip passes between the rolls, and a casting speed.

In accordance with the present invention, the above and other objects can be accomplished by the provision of a method for drawing a strip initially cast by means of a twin roll strip casting apparatus, comprising: a roll gap maintenance step where roll gap is maintained so that a leader strip having a length $l_0$ disposed above roll nip does not fall between rolls; a casting initiation step where a stopper is disengaged from a tundish hole of a tundish so that molten metal is poured into a space between the rolls, and the rolls are rotated at the same speed as an initial starting speed $v_0$ of each of the rolls if the position of the stopper is higher than the actually poured position of the molten metal (rod_offset); a casting speed acceleration step where a roll repulsive force (rolling force) is detected when the molten metal is solidified to the leader strip and passes between the rolls, and the casting speed is accelerated if the roll repulsive force reaches a load threshold; and a normal control step where the casting speed is detected, and if the casting speed reaches a target value, i.e., a normal casting speed, the casting speed is maintained at the normal casting speed.

Preferably, the casting speed acceleration step comprises a rolling force control step where the rolling force is controlled if the roll repulsive force (rolling force) reaches the load threshold.

Preferably, the length $l_0$ of the leader strip is set to complete the initial solidification before the leader strip completely passes through the roll nip, and the initial starting speed $v_0$ is previously set to satisfy the following equation: $v_0=l_0/\Delta t$ ($\Delta t$: the time period from the time where the casting process is initiated to the time where the roll repulsive force reaches the load threshold).

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Now, a preferred embodiment of the present invention will be described in detail with reference to the accompanying drawings.

Figure 1:
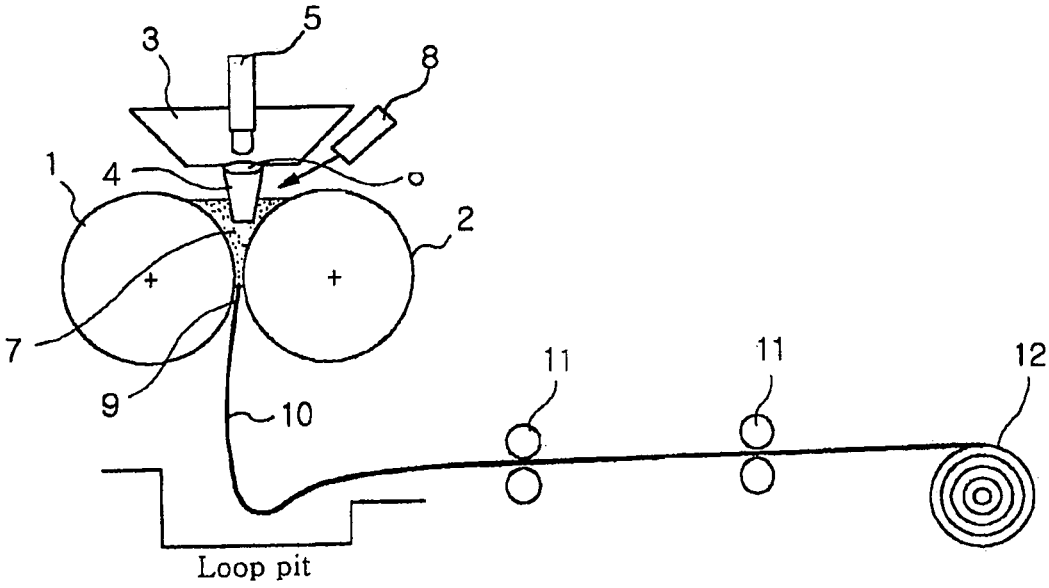
FIG. 1 is a schematic view illustrating a strip casting process in a general twin roll strip casting apparatus.
Figure 2:
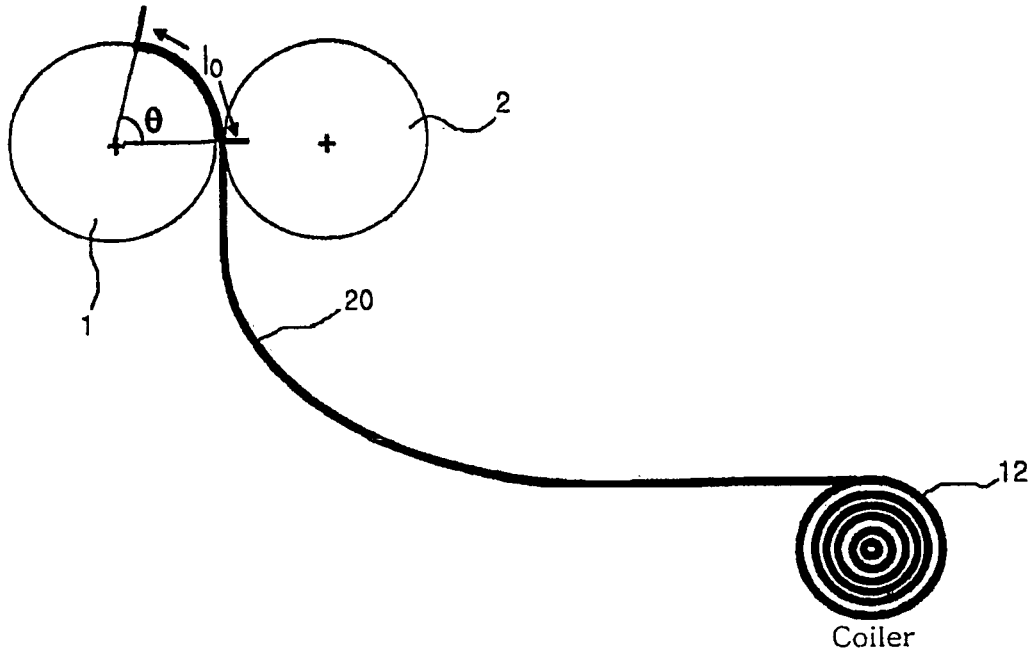
FIG. 2 is a schematic view illustrating a leader strip arranged in a twin roll strip casting apparatus according to a preferred embodiment of the present invention.

FIG. 2 is a schematic view illustrating a leader strip arranged in a twin roll strip casting apparatus according to a preferred embodiment of the present invention. Between the rolls 1 and 2 is disposed a leader strip 20 as shown in FIG. 2. Specifically, the leader strip 20 is in contact with the rolls between the rolls by a prescribed length $l_0$ and by a prescribed angle θ. When being supplied from the tundish 3 to the molten metal receiving space 7 defined between the rolls 1 and 2 through the nozzle 4, the molten metal is solidified between the leader strip and the rolls 1 and 2 within a few seconds, and is then rolled. At this time, the solidified metal is attached to the leader strip 20, and then passes between the rolls along with the leader strip 20 so that the strip 10 is cast. The cast strip 10 creates a roll repulsive force (a rolling force). The roll repulsive force is detected by means of a load cell (not shown) disposed at the rear of the rolls.

Before the strip casting process is initiated, a thin steel plate, having a thickness equal to a gap between the rolls 1 and 2, is arranged from the rolls 1 and 2 to the coiler 12. The steel plate serves to guide the solidified metal attached to the leader strip 20 to the coiler 12 when the strip casting process is initiated. At this time, it is preferable that the thickness of the leader strip 20 is small, if possible. This is because a small load is applied to the rolls while the solidified metal attached to the leader strip having a small thickness passes between the rolls 1 and 2. It should be noted, however, that the steel plate might be molten by means of the molten metal if the thickness of the steel plate is too small. The leader strip 20, to which the molten metal is attached, is provided with a plurality of small holes. Consequently, the molten metal can be quickly solidified when the molten metal is attached to the leader strip 20.

Figure 3:
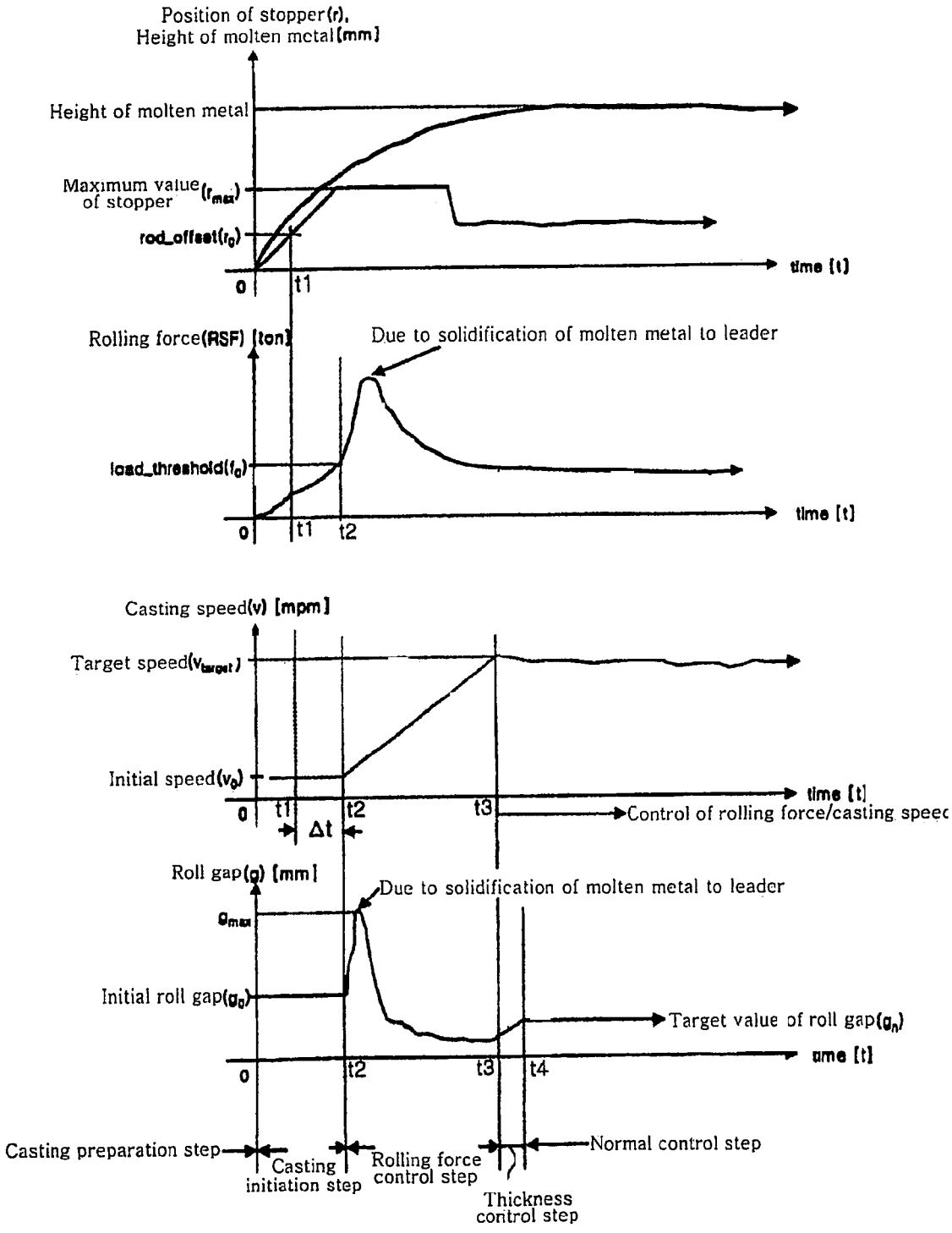
FIG. 3 is a graph illustrating examples of principal data when a strip casting process is initiated according to the present invention.

FIG. 3 is a graph illustrating examples of principal data when a strip casting process is initiated according to the present invention. Specifically, FIG. 3*a* is a graph illustrating position of the stopper 5 and height of the molten metal, FIG. 3*b* is a graph illustrating magnitude of the roll repulsive force RSF, FIG. 3*c* is a graph illustrating casting speed of the strip, and FIG. 3*d* is a graph illustrating change of the roll gap.

The strip drawing process will now be described with reference to FIG. 3. The strip drawing process comprises a casting preparation step, a casting initiation step, a rolling force control step, a thickness control step, and a normal control step. At the casting preparation step, all preparations for casting are complete. Specifically, a position control $g_0$ between the rolls 1 and 2 is carried out so that a prescribed roll gap is maintained. In this case, the position control is carried out while the roll gap is maintained by a prescribed gap distance so that the leader strip 20 does not fall between the rolls 1 and 2. Assuming that the length of the leader strip 20 above the roll nip is $l_0$, it is required that the length of the leader strip be set to complete the initial solidification before the leader strip having the above-mentioned length completely passes through the roll nip. As shown in FIGS. 3*a* to 3*d*, the stopper 5 is engaged in the tundish hole 6 of the tundish 3, and the height of the molten metal is 0 at the casting preparation step. Furthermore, the roll repulsive force RSF is 0, and the casting speed is also 0 mpm since the rolls are not moved.

At the casting initiation step, the stopper 5 is disengaged from the tundish hole 6 of the tundish 3, and therefore the molten metal stored in the tundish 3 is supplied to the space between the rolls. As shown in FIG. 3*a*, the position of the stopper 5 is raised as the stopper 5 is disengaged from the tundish hole 6 of the tundish 3 at the casting initiation step. Also, the height of the molten metal is increasingly raised. At this time, the position control is carried out so that a prescribed roll gap is maintained, as shown in FIG. 3*d*. The rolls are not rotated with the result that the casting speed is 0 as shown in FIG. 3*c*. The rolling force is gradually increased.

Subsequently, it is determined whether the position of the stopper 5 is higher than the position where the molten metal is poured (rod_offset) $r_0$ after the stopper 5 is disengaged from the tundish hole 6 of the tundish 3. From the time t1 at which the position of the stopper 5 is higher than $r_0$, the rolls are rotated at a prescribed speed, i.e., the initial starting speed of each of the rolls $v_0$ (Refer to FIG. 3*c*). The rod_offset is the height of the stopper at which the stopper 5 is actually disengaged from the tundish hole 6 of the tundish 3 while the stopper approaches the maximum value $r_{max}$ from the position of the stopper where the stopper 5 is completely engaged in the tundish hole 6 of the tundish 3. In other words, the stopper 5 is securely engaged in the tundish hole 6 of the tundish 3 by means of a strong force sufficient to prevent the outflow of the molten metal from the tundish 3. As a result, the stopper 5 is mechanically bent. Consequently, the tundish hole of the tundish 3 is closed until the bending phenomenon of the stopper 5 is solved when the stopper 5 is disengaged from the tundish hole 6 of the tundish 3.

When the position of the stopper 5 is higher than $r_0$, the leader strip 20 previously disposed between the rolls 1 and 2 is moved downward at the same speed as the rotating speed of each of the rolls. At this time, the rolling force is gradually increased. It is required that the casting speed and roll gap be maintained so as to the complete the initial solidification before the leader strip having the length $l_0$ completely passes through the roll nip since the length of the leader strip 20 over the roll nip is $l_0$.

Subsequently, the molten metal, which is discharged from the tundish 3, is solidified between the rolls while being attached to the leader strip 20, passes between the rolls, and is then moved downward. The solidified metal is formed in the shape of a strip. The strip passes between the rolls along with the leader strip 20. At this time, the roll repulsive force (rolling force) RSF is created. It is determined whether the roll repulsive force is larger than a load threshold $f_0$.

At the time t2 at which the roll repulsive force is larger than the load threshold $f_0$ as shown in FIG. 3*b*, the casting initiation step is switched to the rolling force control step. Assuming that the time period from the time t1 at which the position of the stopper 5 is higher than $r_0$ to the time t2 at which the roll repulsive force is larger than the load threshold $f_0$ is Δt, $v_0$ is expressed by the following equation. $v_0=l_0/\Delta t$. It is required that $v_0$ be previously calculated and set so as to satisfy the above-expressed condition. At the rolling force control step, the rolling force is controlled at a prescribed value so that damage to the rolls due to excessive solidification is effectively prevented. At the same times the rotation of each of the rolls is accelerated at a previously established acceleration as shown in FIG. 3*c*. As shown in FIG. 3*b*, the rolling force is maximized at the time at which the leader strip 20 is solidified with the molten metal. The position of the stopper 5 is maintained at the normal value when the molten metal is discharged to some degree.

The rolling force control is continuously maintained at the rolling force control step. When the casting speed reaches the target value, i.e., the normal casting speed $v_{target}$ (the time t3) as shown in FIG. 3*c*, the rolling force control step is switched to the thickness control step. At the thickness control step, the ratio of rolling force RSF to the casting speed is controlled. Specifically, the thickness is uniformly maintained on the basis of the thickness control. At the same time, the rolling force is uniformly maintained on the basis of change of the casting speed. At the thickness control step, the thickness of the strip is gradually changed to the final target thickness $g_n$ as shown in FIG. 3*d*. When the thickness of the strip reaches the final target thickness $g_n$ (the time t4) and the height of the molten metal is normally controlled, the rolling control step is switched to the normal control step. At the normal control step, the deviation of the thickness to eccentricity of each of the rolls is compensated for, which is out of the scope of the present invention, and therefore a detailed description thereof will not be given.

As described above, the leader strip is disposed between the rolls prior to the strip casting process, the molten metal initially discharged from the tundish 3 is solidified while being attached to the leader strip when the strip casting process is initiated, and the subsequently cast strip is successively drawn to the coiler. In this way, the strip manufactured by means of the twin roll strip casting apparatus is drawn from the roll nip to the coiler 12. As can be seen from the above description, the casting initiation control using the leader strip is a very important process since the whole strip casting process fails if the casting initiation control is not properly carried out.

The present invention provides a method for drawing the strip that is capable of successfully accomplishing the above-mentioned process. As described above in detail, the molten metal is stably solidified and attached to the leader strip at the early stage of the strip casting process, and is then safely and securely drawn to the coiler 12.

Figure 4:
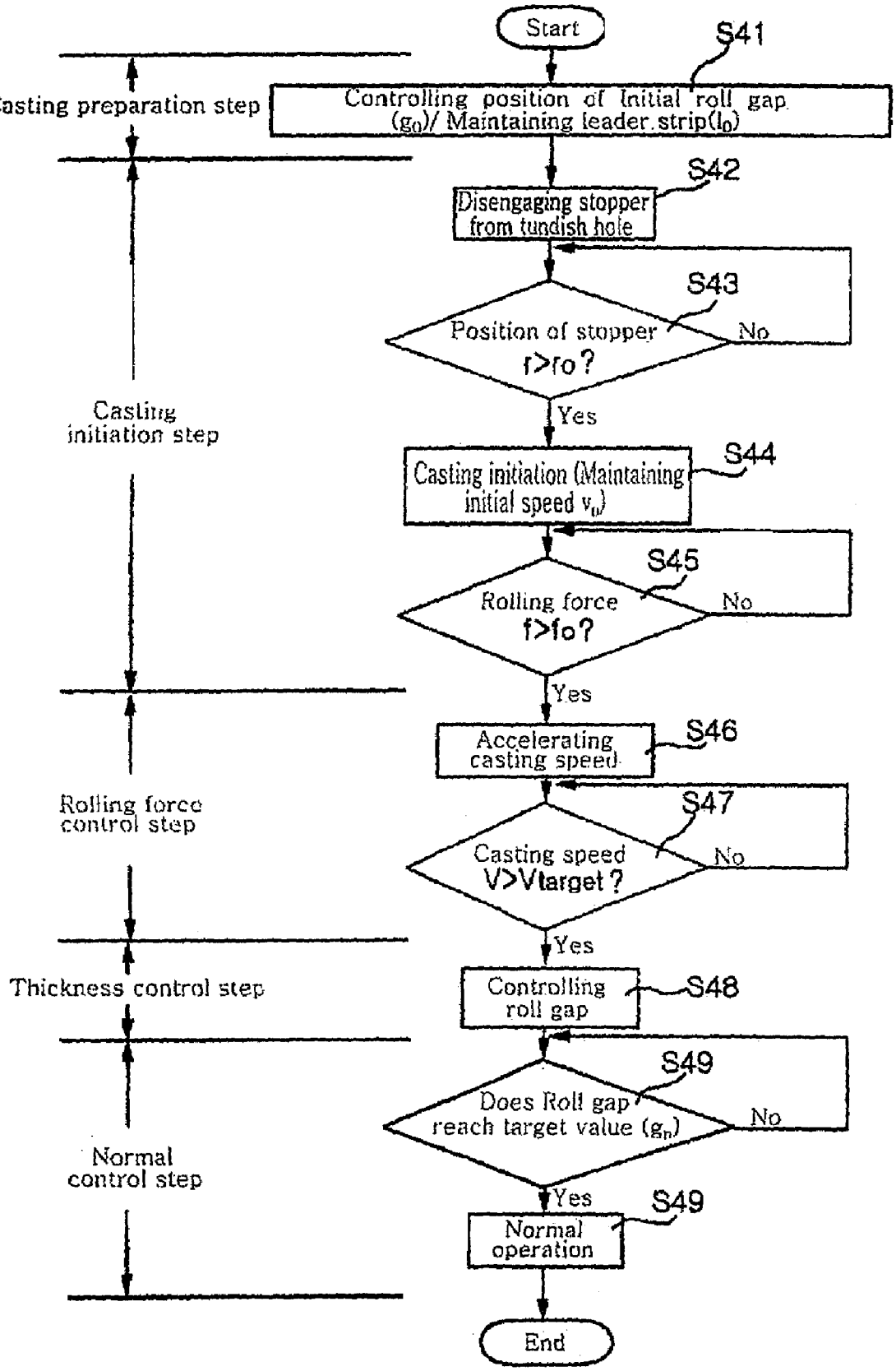
FIG. 4 is a flow chart illustrating a drawing process of the initially cast strip according to the present invention.

FIG. 4 is a flow chart illustrating a drawing process of the initially cast strip according to the present invention. As shown in FIG. 4, the position control of the initial roll gap $g_0$ is carried out, and the length $l_0$ of the leader strip above the roll nip is maintained at the casting preparation step (S41). At this step, the stopper 5 is engaged in the tundish hole 6 of the tundish 3.

The stopper 5 is disengaged from the tundish hole 6 of the tundish 3 at the casting initiation step (S42). As the stopper 5 is disengaged from the tundish hole 6 of the tundish 3, the molten metal stored in the tundish 3 is supplied to the space between the rolls. At this time, the roll gap $g_0$ is maintained, and the rolls are not rotated. It is determined whether the position of the stopper 5 is higher than the position where the molten metal is discharged $r_0$ as the stopper 5 is disengaged from the tundish hole 6 of the tundish 3 (S43). When the position r of the stopper 5 is higher than $r_0$, the rolls are rotated at the initial starting speed $v_0$ (S44). As the rolls are rotated, the leader strip disposed between the rolls is slowly moved downward at the same speed as the rotating speed $v_0$ of each of the rolls. At this time, it is required that, the condition be established to complete the initial solidification before the length l0 of the leader strip completely passes through the roll nip.

As the strip casting process is carried out, the rolling force f is measured, and it is determined whether the rolling force is larger than the load threshold $f_0$ (S45). When the rolling force f is larger than the load threshold $f_0$, the casting initiation step is switched to the rolling force control step, and the casting speed is accelerated (S46). The rolling force is controlled at the above-mentioned rolling force control step so that damage to the rolls due to excessive solidification is prevented.

It is determined whether the casting speed v reaches the target value, i.e., the normal casting speed $v_{target}$ as the casting speed is gradually increased (S47). When it is determined that the casting speed v has reached $v_{target}$ at the above step (S47), the rolling force control step is switched to the thickness control step, and the roll gap is controlled (S48). The thickness of the strip is uniformly maintained by means of the roll gap control. At the same time, the ratio of rolling force to the casting speed is controlled so that the rolling force is uniformly maintained on the basis of change of the casting speed.

Subsequently, it is determined whether the roll gap reaches the final target thickness $g_n$ (S49). When the roll gap reaches the final target thickness $g_n$, the thickness control step is switched to the normal operation step at which the normal operation is carried out. At the normal operation step, the roll eccentricity control is carried out so that the thickness deviation is compensated for.

Through the above-mentioned courses, the strip cast by means of the twin roll strip casting apparatus can be safely drawn from the roll nip to the coiler. In the case that the leader strip is disposed above the roll nip, and the cast strip is drawn to the coiler, the process is accurately controlled on the basis of various conditions, such as the position of the stopper, the casting speed, the rolling force, and the roll gap, so that the strip is safely drawn without error at the casting process.

The above detailed description of the preferred embodiment of the present invention with reference to the accompanying drawings has been given only for illustrative purposes. Therefore, the protective scope of the present invention is not limited by the above detailed description but the accompanying claims.

INDUSTRIAL APPLICABILITY

As apparent from the above description, the present invention provides a method for safely drawing an initially cast strip to a coiler with a leader strip when a strip casting process is initiated, whereby not only a casting process but also a subsequent process is safely carried out.

Furthermore, molten metal is poured while rolls are rotated, whereby no excessive load is applied to the rolls. Also, most functions are processed on the basis of an algorithm, whereby the strip drawing process is economically carried out.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

The invention claimed is:

1. A method for drawing a strip cast by means of a twin roll strip casting apparatus, comprising the steps of:

maintaining a roll gap so that a leader strip having a length $l_0$ disposed above a roll nip does not fall between rolls;

initiating the casting by disengaging a stopper from a tundish hole of a tundish so that molten metal is poured into a space between the rolls, and by rotating the rolls at an initial casting speed $v_0$ for each of the rolls when the position of the stopper is higher than the position where the molten metal (rod_offset) begins to pour from the tundish hole;

accelerating the casting speed when a roll repulsive force (rolling force) is detected as reaching a load threshold indicating that the molten metal is solidified to the leader strip and passing between the rolls; and maintaining the casting speed when the casting speed reaches a target value (normal casting speed).

2. The method as set forth in claim 1, wherein the length $l_0$ of the leader strip is selected so that initial solidification is completed before the leader strip completely passes through the roll nip.

3. The method as set forth in claim 1, wherein the accelerating step further comprises the step of controlling the roll repulsive force when the roll repulsive force (rolling force) reaches the load threshold.

4. The method asset forth in claim 1, wherein the initial casting speed $v_0$ is set to $l_0/\Delta t$, where $\Delta t$, is the time period from the time where the casting process is initiated to the time where the roll repulsive force reaches the load threshold.

* * * * *

UNITED STATES PATENT AND TRADEMARK OFFICE

CERTIFICATE OF CORRECTION

PATENT NO. : 7,100,674 B2
APPLICATION NO. : 10/535216
DATED : September 5, 2006
INVENTOR(S) : Yoon-Ha Kim, Wan-Soo Kim and Dae-Sung Lee It is certified that error appears in the above-identified patent and that said Letters Patent is hereby corrected as shown below:

On the Title Page, Item " (73) Assignee: Posco Co., Ltd., Pohang-shi (KR)" should read -- (73) Assignee: Posco Co., Ltd., Pohang-shi (KR); Research Institute of Industrial Science & Technology, Pohang-shi (KR) --.

Signed and Sealed this

Twenty-second Day of May, 2007

JON W. DUDAS
*Director of the United States Patent and Trademark Office*